US006512203B2

(12) United States Patent
Jones et al.

(10) Patent No.: US 6,512,203 B2
(45) Date of Patent: Jan. 28, 2003

(54) POLYMER THICK FILM HEATING ELEMENT ON A GLASS SUBSTRATE

(75) Inventors: Barrie M. Jones, Knoxville, TN (US); Mark A. Kimmet, Knoxville, TN (US)

(73) Assignee: Polymore Circuit Technologies, Maryville, TN (US)

( * ) Notice: Subject to any disclaimer, the term of this patent is extended or adjusted under 35 U.S.C. 154(b) by 0 days.

(21) Appl. No.: 09/952,344

(22) Filed: Sep. 14, 2001

(65) Prior Publication Data

US 2002/0011477 A1 Jan. 31, 2002

Related U.S. Application Data

(63) Continuation-in-part of application No. 09/306,250, filed on May 6, 1999.

(51) Int. Cl.[7] ..... H05B 1/00
(52) U.S. Cl. ..... 219/219
(58) Field of Search ..... 219/219, 543, 219/522, 203; 338/307, 309; 52/171

(56) References Cited

U.S. PATENT DOCUMENTS

| | | | | |
|---|---|---|---|---|
| 3,909,680 A | | 9/1975 | Tsunashima | |
| 4,081,601 A | | 3/1978 | Dinella et al. | |
| 4,628,187 A | | 12/1986 | Sekiguchi et al. | |
| 4,857,711 A | | 8/1989 | Watts | |
| 4,931,627 A | | 6/1990 | Watts | |
| 5,019,944 A | | 5/1991 | Ishii et al. | |
| 5,162,950 A | | 11/1992 | Suman et al. | |
| 5,181,006 A | | 1/1993 | Shafe et al. | |
| 5,205,635 A | | 4/1993 | Van Order et al. | |
| 5,406,049 A | | 4/1995 | Reiser et al. | |
| 5,440,425 A | | 8/1995 | Kadooka et al. | |
| 5,517,003 A | | 5/1996 | Kadooka et al. | |
| 5,521,357 A | * | 5/1996 | Lock et al. | 219/541 |
| 5,990,449 A | | 11/1999 | Sugiyama et al. | |
| 6,037,572 A | * | 3/2000 | Coates et al. | 219/451.1 |

* cited by examiner

*Primary Examiner*—Henry Bennett
*Assistant Examiner*—Vinod D Patel
(74) *Attorney, Agent, or Firm*—Pitts & Brittian, P.C.

(57) ABSTRACT

Apparatus and methods for attaching a heating element to a glass substrate. The heating element is formed of a plurality of conductive polymer thick film inks screen printed on the substrate. The heating element includes a resistive strip or resistor, conductive strips or conductors, and terminal portions, which form part of an electrical circuit. Electrical power applied to the terminal portions causes current to flow through the resistive strip, which generates heat through resistive heating. The heat is transferred to the substrate. The method of applying the heating element to the substrate includes, in one embodiment, screen printing polymer thick film materials onto a surface of a glass substrate to form the circuit conductors and resistive elements and surface mounting other components of the circuit on the substrate.

20 Claims, 5 Drawing Sheets

POLYMER THICK FILM HEATING ELEMENT ON A GLASS SUBSTRATE

CROSS-REFERENCE TO RELATED APPLICATIONS

This application is a Continuation-in-part of Ser. No. 09/306,250, filed May 6, 1999.

STATEMENT REGARDING FEDERALLY SPONSORED RESEARCH OR DEVELOPMENT

Not Applicable

BACKGROUND OF THE INVENTION

1. Field of Invention

This invention pertains to apparatus and methods for applying a polymer thick film to a substrate. More particularly, this invention pertains to apparatus and methods for integrating a heating element on mirrors and glass substrates, such as used in motor vehicles.

2. Description of the Related Art

It is often quite useful to be able to place electrical or electronic devices on or very close to the surface of a glass substrate. Without meaning to limit the scope of the present invention, typical examples of such uses are with respect to the mounting of lights in the vicinity of vanity mirrors for use in automobile visors or placing a heating element near the surface of a glass. For example, U.S. Pat. No. 5,162,950, titled "Lighted Mirror Assembly for Motor Vehicle Visor," and issued to Suman, et al., on Nov. 10, 1992, discloses an illuminated vanity mirror assembly with a resistor screen-printed on a polymeric film substrate glued to the back face of the mirror.

In a manner similar to the lamps in the Suman patent, automobile mirror heaters are screen printed onto flexible polyester substrates and attached to mirrors with an adhesive backing. The heaters are typically made with a special thermoplastic carbon ink known as positive temperature coefficient carbon (PTC). These heaters are said to be self-regulating because as the heater warms up, its resistance increases, thereby reducing power. In practice, PTC heaters are not very efficient because the resistance change is not great enough to turn off the power. In a car, when the ignition is on, if the heater is not connected through a thermal switch or a timer, the heater draws power continuously whether it is needed or not. Since heat accelerates the aging process, traditional automobile mirror heaters are vulnerable to premature failure unless they are fitted with thermal switches or timers. Connecting mirror heaters to a timer or thermal switch improves their reliability and removes the need to use expensive PTC carbon.

Examples of electrical heaters using PTC are evidenced in various patents. For example, U.S. Pat. No. 4,628,187, titled "Planar Resistance Heating Element," issued to Sekiguchi, et al., on Dec. 9, 1986, discloses a positive temperature coefficient (PTC) heating element on an insulating substrate. The heating element is covered with a phenolic resin layer, which has an adhesive layer protected by an insulating film. The heating element disclosed in the Sekiguchi patent is suitable for attaching, by way of the adhesive layer, to an object that is required to be heated.

U.S. Pat. No. 4,857,711, titled "Positive Temperature Coefficient Heater," issued to Watts on Aug. 15, 1989, discloses a self-regulating heating device for automotive-type outside rearview mirrors. U.S. Pat. No. 4,931,627, titled "Positive Temperature Coefficient Heater with Distributed Heating Capability," issued to Watts on Jun. 5, 1990, is based on a continuation-in-part application of the '711 patent. The two Watts patents teach the use of a positive temperature coefficient (PTC) material to form the heater on a mylar backing, which is adhered to the back surface of the mirror. The Watts patents further disclose the power carrying buss bar tapering to a smaller size the further the buss is from the power connection to the heater. The tapered buss maintains a constant power density along its length and serves as a heating element, in addition to the PTC heating elements.

U.S. Pat. No. 5,181,006, titled "Method of Making an Electrical Device Comprising a Conductive Polymer Composition," issued to Shafe, et al., on Jan. 19, 1993, discloses heaters made from PTC conductive polymer compositions applied as polymer thick film inks.

Alternatives to using PTC material as the heating element have been used. For example, U.S. Pat. No. 5,406,049, titled "Fog-Resistant Mirror Assembly," issued to Reiser, et al., on Apr. 11, 1995, discloses a conductive coating applied to a mirror, such as found in a bathroom. The coating of the Reiser patent includes scribe lines to control the length of the conductive path, and the scribe lines require a high-dielectric-strength coating to prevent arcing. Conductive buses of ultra thin foil tape adhered to the conductive coating are used for making the power supply connections and for spanning the scribe lines. The Reiser patent also discloses a heater controller using a voltage comparator and an SCR for controlling the alternating current to the heater.

U.S. Pat. No. 5,440,425, titled "Rearview Mirror with Heater for Defrosting and Defogging," issued to Kadooka, et al., on Aug. 8, 1995, discloses a heater element adhered to the back surface of a mirror, which is fixed in a housing. The Kadooka patent discloses a self-controlled heater formed by applying a silver printed conductive track to a semiconductor plate. The semiconductor plate is formed of a low density polyethylene and includes ethylene vinyl acetate copolymer, calcium stearate, and conductive lampblack. A second patent issued to Kadooka, et al., U.S. Pat. No. 5,517,003, titled "Self-Regulating Heater Including a Polymeric Semiconductor Substrate Containing Porous Conductive Lampblack," issued on May 14, 1996, discloses a self-controlled heater for use with a rear-view mirror. The heater in this patent is also formed of a low density polyethylene and includes ethylene vinyl acetate copolymer, calcium stearate, and conductive lampblack.

U.S. Pat. No. 5,990,449, titled "Electric Heating Device for Mirror," issued to Sugiyama, et al., on Nov. 23, 1999, discloses a mirror in which the reflective film or coating also serves as a heater element. The Sugiyama patent teaches the use of aluminum, chromium, or NICHROME and similar silicides for the heater element.

Integrating electrical circuitry in motor vehicle components is evidenced in various patents. For example, U.S. Pat. No. 5,205,635, titled "Vehicle Accessory Body and Integral Circuit," issued to Van Order, et al., on Apr. 27, 1993, discloses laminating an electrical foil layer on a vehicle accessory body molding in order to eliminate the use of discrete wires or wiring harnesses.

Various apparatus and methods for integrating electrical circuitry onto a substrate are known. Additionally, various techniques are known for making electrical connections to components mounted on the substrate. For example, U.S. Pat. No. 4,081,601, titled "Bonding Contact Members to Circuit Boards," issued to Dinella, et al., on Mar. 28, 1978, discloses a conductive overlay solder-bonded over a contact finger top surface area and having a gold surface layer. U.S.

Pat. No. 5,019,944, titled "Mounting Substrate and Its Production Method, and Printed Wiring Board Having Connector Function and Its Connection Method," issued to Ishii, et al., on May 28, 1991, discloses using metal nodules and adhesive to make electrical contact and to mount components to a substrate.

U.S. Pat. No. 3,909,680, titled "Printed Circuit Board with Silver Migration Prevention," issued to Tsunashima on Sep. 30, 1975, discloses a technique for preventing migration of silver contained in printed conductors applied to an insulating substrate. The Tsunashima technique uses a coating composed of electrically insulating resin and an organic inhibitor.

BRIEF SUMMARY OF THE INVENTION

Apparatus and methods of applying a polymer thick film to a substrate are provided. According to one embodiment of the present invention, two conductive strips are applied to a glass substrate and a resistive strip is applied to the glass substrate, with the resistive strip in electrical contact with the conductive strips. The resistive strip is formed by applying a low-ohm thermosetting carbon polymer thick film to the glass substrate. The polymer thick film has a specified resistance. Each conductive strip has a terminal portion in which electrical connections are made to an electrical power source. Power applied to the electrical connections causes current to flow from one conductive strip, through the resistive strip, and to the other conductive strip. The current flow through the resistive strip causes the temperature of the resistive strip to increase. The heat from the resistive strip is conducted to the glass substrate, causing the glass substrate temperature to increase. In another embodiment, a heater controller senses and controls the current flowing through the resistive strip to provide control of the glass substrate temperature. In still another embodiment, the resistive elements of the heater control circuit are printed on the glass substrate and the remaining components are mounted on the glass substrate, eliminating the need for a circuit board. In one embodiment, the resistive strip and conductive strips are coated with a dielectric. In another embodiment, a backing material is adhered to the strips and the substrate.

The method of applying a polymer thick film to a glass substrate, in one embodiment, includes the steps of preparing the substrate, applying a conductive strip to a specified area of one surface of the substrate, applying a resistive strip to the surface of the substrate, applying a dielectric over the strips, and applying electrical connection pads to each conductive strip. The resistive strip is applied after, and overlapping, the conductive strips. In another embodiment, the heater control circuit resistive elements are applied to the substrate as resistive strips and the other heater control circuit components are installed on the substrate and soldered to electrical connection pads. A still another embodiment includes the step of applying a protective barrier over the heating element. The protective barrier is a thick polymer layer adhered to the heating element.

BRIEF DESCRIPTION OF THE SEVERAL VIEWS OF THE DRAWINGS

The above-mentioned features of the invention will become more clearly understood from the following detailed description of the invention read together with the drawings in which.

DETAILED DESCRIPTION OF THE INVENTION

Apparatus and methods of fabricating a heater integral to a substrate are disclosed. In one embodiment, the heating element is formed on the substrate. In another embodiment, a portion of the control circuit, in addition to the heating element, is formed on the substrate.

Figure 1:
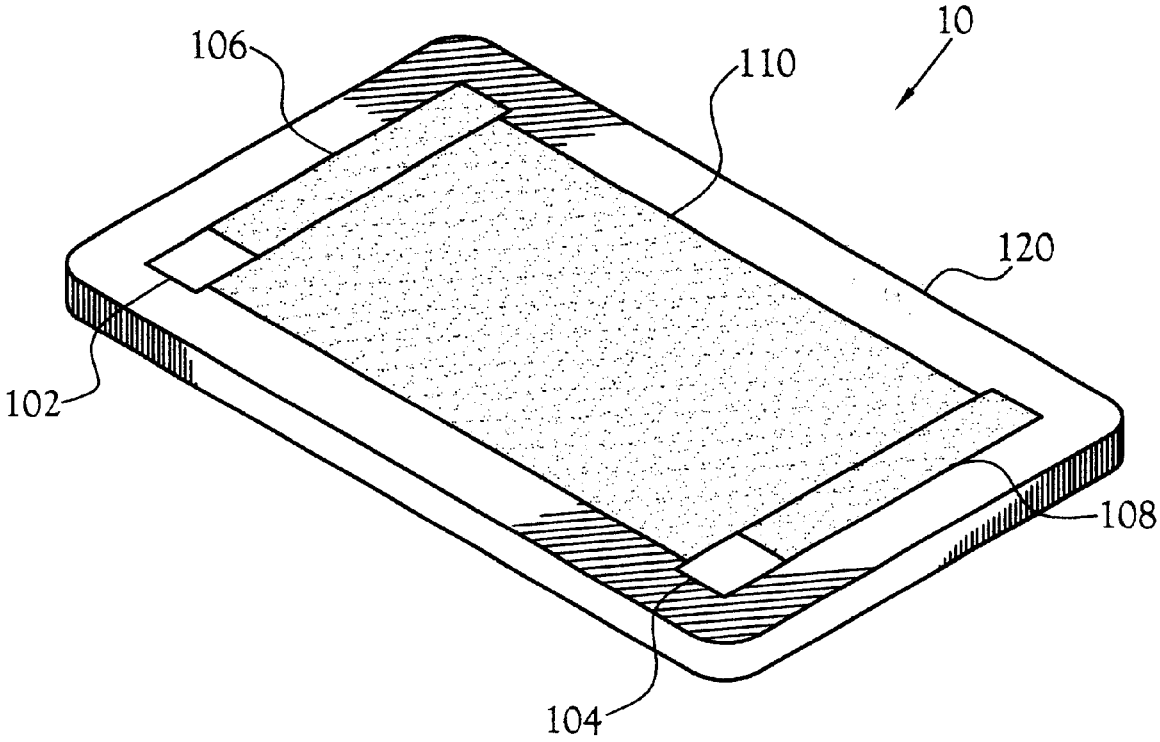
FIG. 1 is a perspective view of a substrate with multiple strips of polymer thick film.

FIG. 1 illustrates one embodiment of the present invention in which two conductive strips, or conductors, 106, 108 are applied to a glass substrate 120 and a resistive strip, or resistor, 110 is applied to the glass substrate 120 and in electrical contact with the conductive strips 106, 108. Each conductive strip 106, 108 has a terminal portion 102, 104 in which electrical connections are made to an electrical power source or external electrical circuit (not illustrated). The resistive strip 110 and the conductive strips 106, 108 are coated with a dielectric (not illustrated) that provides environmental and electrical protection of the heater circuit. Power applied to the electrical connections causes current to flow from one conductive strip 106, through the resistive strip 110, and to the other conductive strip 108. The current flow through the resistive strip 110 causes the temperature of the resistive strip 110 to increase. The heat from the resistive strip 110 is conducted to the glass substrate 120, causing the glass substrate 120 temperature to increase.

FIG. 1 illustrates an embodiment with a substrate 120 having a flat surface. In another embodiment, the substrate has a curved surface on which the strips are applied. In still another embodiment, the substrate 120 is a mirror, such as a side-view outside mirror on a vehicle. Typically, mirrors are formed from a glass substrate with a reflective coating applied to the reverse. The reflective coating is oftentimes painted or coated with a protective film. The conductive strips 106, 108 and the resistive strip 110 are in contact with the mirror coating.

The resistive strip 110 and the conductive strips 106, 108 are formed by applying a conductive polymer thick film ink with specified properties to the glass substrate 120. Generally, polymer thick film inks are screen printable resins that include conductive fillers, such as silver, copper, and other conductive materials (for a conductive polymer thick film ink), resistive fillers, such as carbon, (for a resistive polymer thick film ink), or no fillers (for an insulating polymer thick film ink). The properties of the polymer thick film ink include, but are not limited to, electrical conductivity. Typically, these properties are varied by changing the materials in the ink. For example, the conductive strips 106, 108 require high electrical conductivity; therefore, an ink with copper, silver, or other conductive material is used, with silver producing an ink with higher electrical conductivity than copper. The resistive strip 110 requires a lower electrical conductivity; therefore, an ink with carbon is used, with the amount of carbon used controlling the conductivity.

In one embodiment, an ink with carbon is used for the resistive strip 110. The electrical conductivity, or inversely, the resistivity, of the ink is controlled by adjusting the amount of conductive material in the ink. In this embodiment, the resistive ink is a low-ohm carbon ink. This type of ink maintains a relatively constant resistance with respect to temperature and is less expensive than positive temperature coefficient (PTC) carbon ink.

Polymer thick film ink has other properties, including viscosity, which determine the method of application. Selecting the viscosity and other properties for a particular method of application is known in the art. Those skilled in the art will recognize that any of various conductive inks can be used without departing from the spirit and scope of the present invention.

In one embodiment, the terminal portions, or area, 102, 104 are formed of solder paste applied to an exposed portion of the conductive strips 106, 108. Electrical connectors 602 or wire ends are placed in conjunction with the terminal portions 102, 104 and the solder is re-flowed, thereby forming an electrical connection between the terminal portions 102, 104 and the external circuit. In another embodiment, the terminal portions 102, 104 are formed with a conductive surface to which electrical connections are made by mechanical contact of an external circuit to the exposed conductive surfaces of the terminal portions 102, 104. The mechanical contact is achieved by a spring clip or probe connected to the external circuit, which, when in mechanical contact with the exposed conductive surface, forms an electrical connection. Another embodiment of the present invention provides that the terminal portions 102, 104 are attached to at least a portion of the conductive strip by the use of a conductive adhesive.

Figure 2:
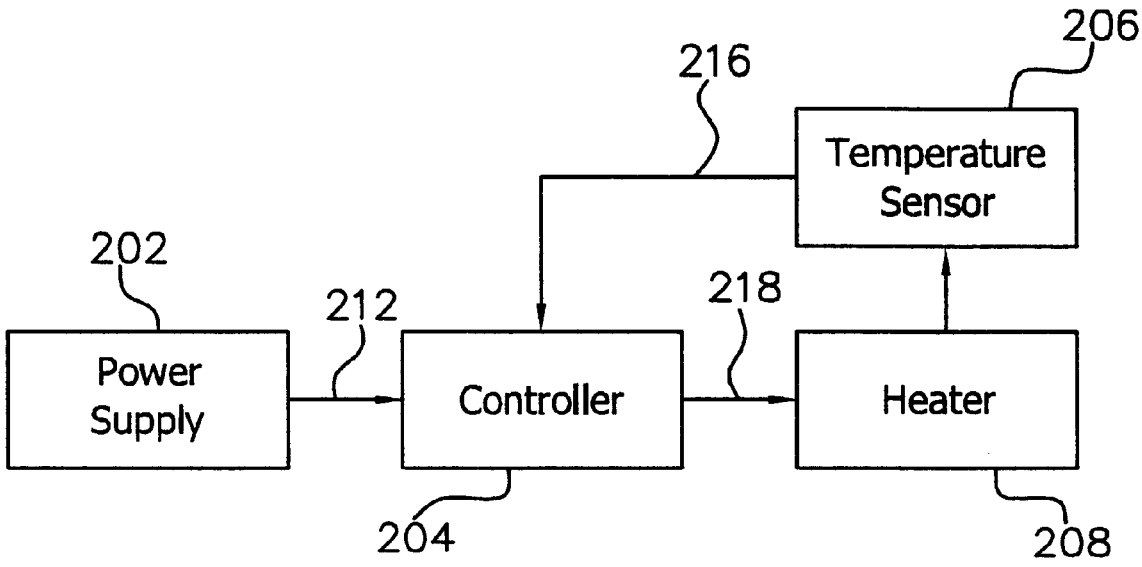
FIG. 2 is a block diagram of a heater controller.

FIG. 2 illustrates a simplified block diagram of a heater controller circuit with feedback. A power supply 202 feeds power 212 to a controller 204, which controls the power 218 to a heater 208. A temperature sensor 206 monitors the temperature of the heater 208 and provides a feedback signal 216 to the controller 204. The controller 204 adjusts the power 218 fed to the heater 208 based on the sensed temperature.

Figure 3:
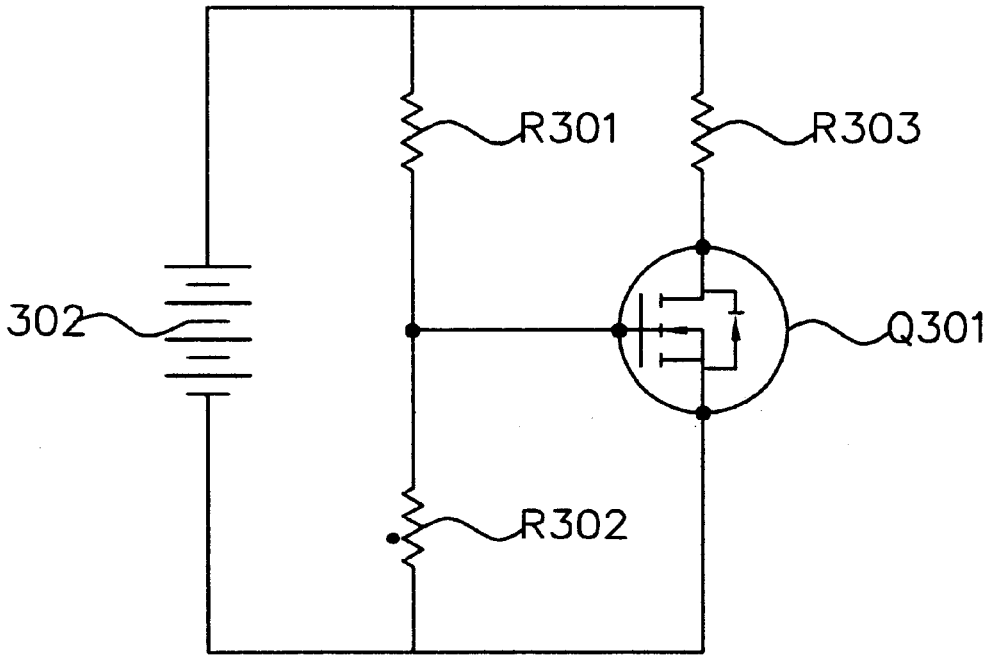
FIG. 3 is a schematic diagram of a temperature controller.

FIG. 3 illustrates a heater controller circuit for controlling a heater such as illustrated in FIG. 1. A battery 302 serves as the power supply 202. The resister R301 and the thermistor R302 form a voltage divider that feeds a control signal to the base of a metal oxide semiconductor field effect transistor (MOSFET) Q301. The MOSFET Q301 is wired in common source configuration with the drain connected to the heater R303. The MOSFET Q301 operates as a voltage controlled potentiometer. The control voltage, set by the voltage divider R301, R302, varies with temperature, which is sensed by the thermistor R302. The output resistance of the MOSFET Q301, which varies typically from 0.1 Ω to greater than 200KΩ, is directly related to the gate voltage. The heater resistance R303 and the voltage supply 202 determines the current rating and power rating of the MOSFET Q301. With this type of circuit, maximum MOSFET Q301 power occurs when the MOSFET Q301 drain voltage is half the supply voltage. Lowest MOSFET power occurs when the MOSFET is fully on or fully off.

Figure 4:
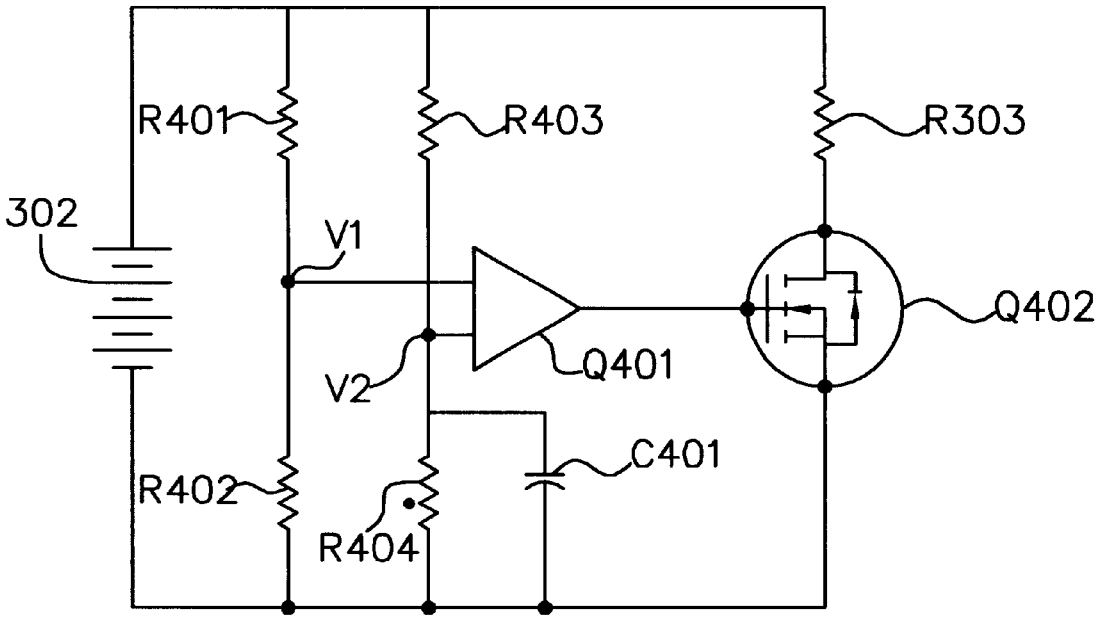
FIG. 4 is a schematic diagram of another embodiment of a temperature controller.

FIG. 4 illustrates another embodiment of a heater controller circuit for controlling a heater such as illustrated in FIG. 1. Unlike the circuit illustrated in FIG. 3, which continually adjusts the power to the heater to regulate its temperature, the circuit of FIG. 4 switches the heater on and off based on the sensed temperature. An operational amplifier Q401 acts as a voltage comparator that switches the MOSFET Q402 on and off. The voltage divider formed by the resistor R401 and the resistor R402 provide a reference voltage V1, which is compared to the voltage V2 of the voltage divider formed by the resistor R403 and the thermistor R404. As the sensed temperature rises and the resistance of the thermistor R404 increases, the voltage V2 increases. The output of the voltage comparator Q401 changes from low to high depending upon whether the voltage V2 exceeds the reference voltage V1. The bistable output of the voltage comparator Q401 is connected to the gate of the MOSFET Q402 and causes the MOSFET Q402 to pass either minimum or maximum current, depending on whether the output of the voltage comparator Q401 is low or high. A bypass capacitor C401 ensures the output is clean and noise-free at the threshold point, thus preventing the MOSFET Q402 from operating in the high power zone. The circuit of FIG. 4, although requiring additional components, does not require an expensive high-power MOSFET as does the circuit of FIG. 3. In one embodiment, the resistors R401, R402 are formed by applying resistive ink to the substrate 120, and the other components are surface mounted on the substrate 120. Those skilled in the art will recognize that the heater circuits depicted in FIGS. 3 and 4 are illustrative and can be varied, depending upon the actual components used, without departing from the spirit and scope of the present invention.

Figure 5:
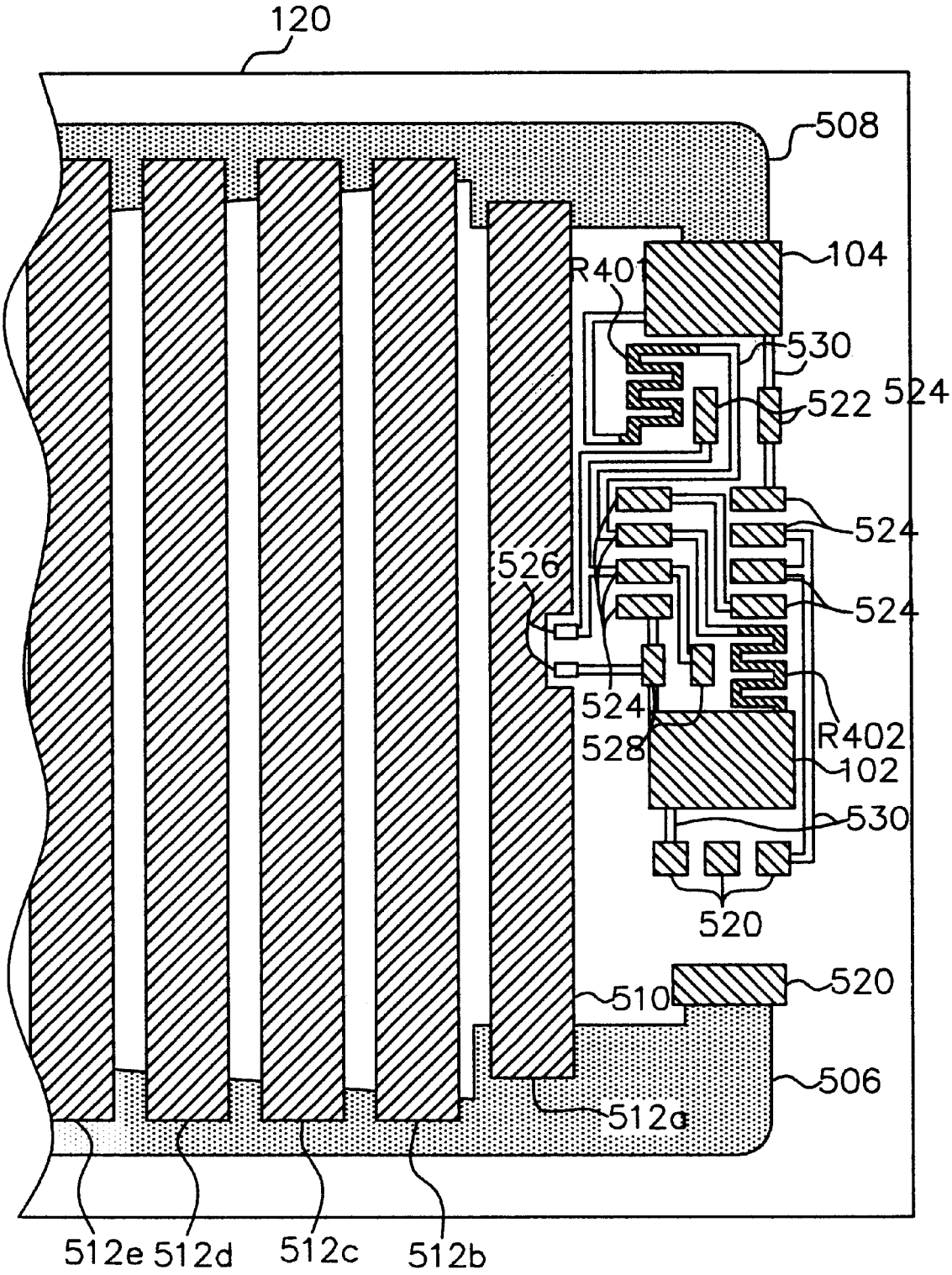
FIG. 5 is a top view of one embodiment with a heater circuit and a controller printed on a substrate.

FIG. 5 illustrates one embodiment of a heater circuit on a substrate. The conductive strips 506, 508 span opposite edges of one surface of the glass substrate 120. The resistive strips 510, 512 extend from the first conductive strip 506 to the second conductive strip 508. The resistive strips 510, 512 overlap the conductive strips 506, 508. In the illustrated embodiment, the conductive strips 506, 508 have a shape that becomes wider in the transverse direction as the conductive strips 506, 508 extend away from the circuit connections 520, 104. This expansion in the width serves to distribute the power evenly to the resistive strips 512.

The resistive strip 510 has an indentation at its midpoint, near the mounting pads 526 for the thermistor R404. This arrangement permits the thermistor R404, after it is soldered to the mounting pads 526, to monitor the temperature of the resistive strip 510.

FIG. 5 illustrates the interconnecting conductive strips 530 that provide an electrical path between the various circuit elements. Also shown are the MOSFET Q402 mounting pads 520, the resistor R403 mounting pads 522, the operational amplifier Q401 mounting pads 524, the thermistor R404 mounting pads 526, the capacitor C401 mounting pads 528, and the terminal portion or areas 102, 104. The exposed surfaces of the mounting pads 520, 522, 524, 526, 528 and the terminal areas 102, 104 are conductive ink with copper filler and are suitable for re-flow soldering. FIG. 5 shows two resistors R401, R402 screen printed on the substrate 120 and connected to the power supply 302 terminal areas 102, 104 and to one connection pad 524 for the operational amplifier Q401.

Figure 6:
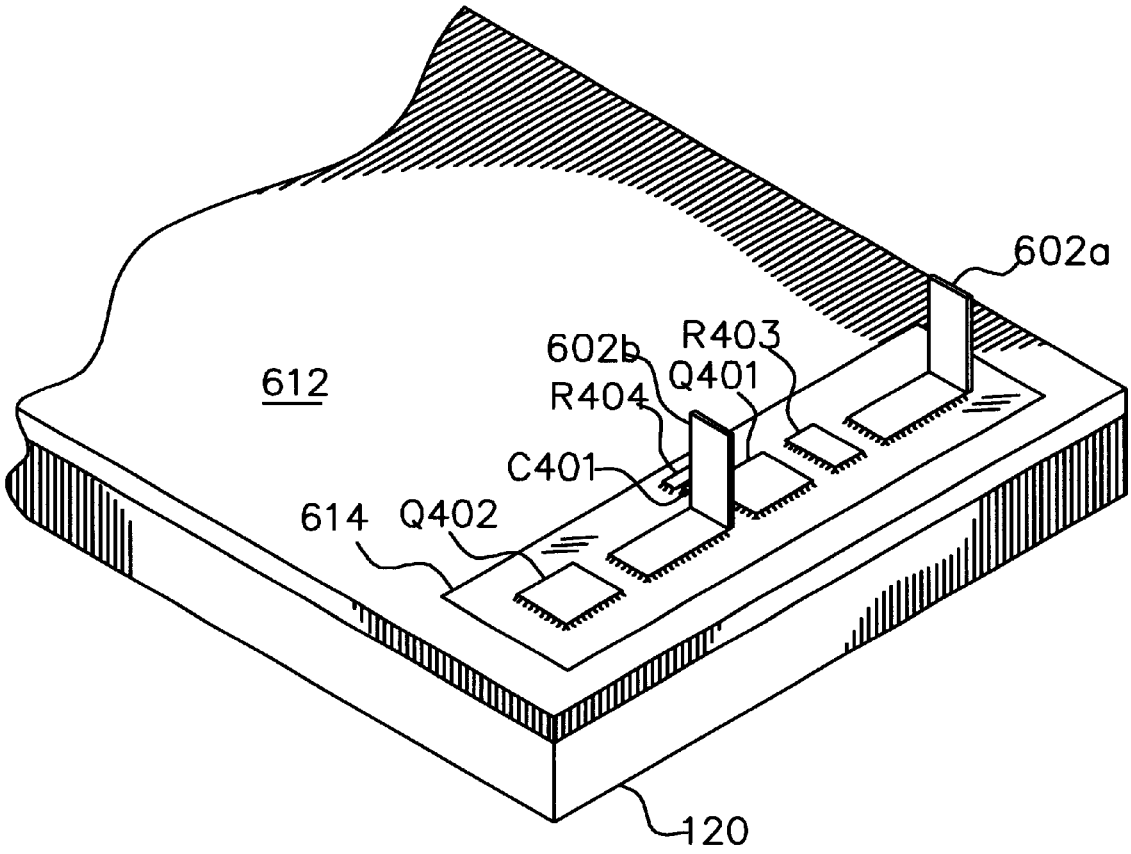
FIG. 6 is an isometric view of one embodiment of a substrate with a heater circuit encapsulated with a potting compound and showing the electrical terminals.

FIG. 6 illustrates an embodiment of a heater circuit on a substrate with the control circuit encapsulated in a potting compound 614 and the heater element and substrate 120 covered with a backing material 612. A pair of power supply connection terminals 602*a*, 602*b* are shown extending from the substrate 120. The resistor R403, the thermistor R404 the operational amplifier Q401, the MOSFET Q402, the capacitor C401 are surface mounted to the substrate 120 by re-flow soldering their connection pads to the mounting pads 520, 522, 524, 526, 528. A backing material or protective membrane 612, sized to cover the substrate 120 and with a cutout sized to fit the controller circuit and the terminals 602*a*,

602*b*, is adhered to the substrate 120 and polymer thick film ink layers. The backing material 612 cutout is filled with a potting compound 614 to protect and seal the controller circuit components. In one embodiment, the backing material 612 is used in lieu of the dielectric layer. In another embodiment, the backing material 612 is used in conjunction with the dielectric layer. The backing material 612, in one embodiment, is either paper, a vinyl sheet, a flexible elastomeric sheet, or some other material glued to the substrate and covering the polymer thick film ink layers. The backing material 612 serves to hold the pieces of the substrate 120 if the substrate 120 were to shatter or break. The backing material 612 also protects the circuit applied to the substrate 120.

In one embodiment, the method of attaching a heating element to a substrate includes the steps of preparing the substrate, applying conductive ink 106, 108 to a specified area of one surface of the substrate 120, applying a resistive ink 110 to the surface of the substrate 120, applying a dielectric over the cured ink, and applying electrical connection pads 102, 104 to each conductive strip 106, 108. The final step is electrical testing to verify ink resistance and operability.

The polymer thick film inks are applied by screen printing the ink and then by curing the ink with heat. These steps are followed for each successive layer of ink and for applying the dielectric.

The conductive strips 106, 108 are the power bus for the heater and must have a low sheet resistance, otherwise heat will not be evenly distributed throughout the heater 110. In one embodiment, the conductive strip material is a silver ink with a sheet resistance of approximately 20 mΩ/Sq. In one embodiment, a thermosetting carbon ink of approximately 20 Ω/Sq. is used for the resistive strip heating element 110. The final dielectric is a relatively thick vinyl coating that insulates and protects the heating element. The flexible vinyl coating also prevents the glass from breaking into loose pieces in the event that the glass becomes shattered. Another embodiment uses a backing sheet, either by itself without the dielectric coating or over the dielectric coating, adhered to the substrate and polymer thick film inks. Those skilled in the art will recognize that various materials can be used for the dielectric and the backing sheet without departing from the spirit and scope of the present invention.

The electrical test is a resistance measurement to determine whether the applied circuit elements are within tolerance. Generally, a preferred tolerance of ±20% is acceptable; however, if it is necessary to have a tighter tolerance, ±10% is possible. If a soldered connection to the heater is required, a footprint of copper can be printed on top of the silver. Solderable polymer thick film (PTF) copper has a sheet resistance of approximately 100 mΩ/Sq. and is suitable for use in place of the silver for low power heaters. If the copper resistance were too high for the power bus, another step of applying copper would be required after the step of applying the silver conductive strip.

In another embodiment, the method of attaching a heating element to a substrate includes attaching a heater and the control circuitry to the substrate. The method includes the steps of applying conductive ink to a specified area of one surface of the substrate, applying resistive ink to the surface of the substrate, applying copper to the substrate, applying a dielectric, applying solder paste, assembling components, and re-flow soldering the components. The final step is electrical testing. In the embodiment illustrated in FIG. 4, the resistive ink forms the heating element R303 and the control circuit resistors R401, R402. The other components Q401, Q402, C401, R403, R404 are surface mounted components. Another embodiment includes the step of adhering a backing material 612 to the substrate 120 and ink layers.

The methods described above are not limited to attaching a single heating element to a substrate. For flat substrates, an array of heating elements are applied to a substrate, which is then cut into individual sections. Curved substrates are printed on single line multiple nest plates and assembled as single substrates.

From the foregoing description, it will be recognized by those skilled in the art that apparatus and methods of attaching a heating element to a glass substrate has been provided. The heating element is formed from various conductive polymer thick film inks applied to a substrate. The heating element includes a resistive strip or film, conductive strips or conductors, and terminal portions or areas, which form part of an electrical circuit. Electrical power applied to the terminal portions causes current to flow through the resistive film, which generates heat through resistive heating. The heat is transferred to the substrate.

While the present invention has been illustrated by description of several embodiments and while the illustrative embodiments have been described in considerable detail, it is not the intention of the applicant to restrict or in any way limit the scope of the appended claims to such detail. Additional advantages and modifications will readily appear to those skilled in the art. The invention in its broader aspects is therefore not limited to the specific details, representative apparatus and methods, and illustrative examples shown and described. Accordingly, departures may be made from such details without departing from the spirit or scope of applicant's general inventive concept.

Having thus described the aforementioned invention, We claim:

1. An apparatus for electrically heating a substrate, said apparatus comprising:

a substrate having a surface, said substrate being a glass material;

a first conductor adhered to said surface;

a second conductor adhered to said surface;

a resistive film adhered to said surface, said resistive film in electrical contact with said first conductor, said resistive film in electrical contact with said second conductor;

a temperature sensor attached to said substrate; and a controller in electrical communication with said temperature sensor, said first conductor, and said second conductor, said controller having a circuit formed on said substrate.

2. The apparatus of claim 1 wherein said resistive film is formed from a polymer thick film ink having a specified conductivity, said resistive film being applied to said surface.

3. The apparatus of claim 1 wherein said first conductor is formed from a first conductive polymer thick film ink and said second conductor is formed from a second conductive polymer thick film ink.

4. The apparatus of claim 1 further comprising a dielectric in contact with said resistive film, said first conductor, and said second conductor.

5. The apparatus of claim 1 further comprising a backing sheet in contact with said resistive film, said first conductor, and said second conductor, whereby said backing sheet protects said resistive film, said first conductor, and said second conductor from an external environment.

6. The apparatus of claim 1 wherein said substrate is a mirror, and said surface has a reflective coating.

7. The apparatus of claim 1 wherein said controller is encapsulated in a potting compound.

8. The apparatus of claim 1 wherein said temperature sensor is a thermistor, said temperature sensor in contact with a pair of thickflm conductors adhered to said surface, and said controller includes a semiconductor switch.

9. The apparatus of claim 1 wherein said resistive film includes a plurality of strips, each of said plurality of strips extending from said first conductor to said second conductor, each of said plurality of strips in a spaced apart configuration.

10. The apparatus of claim 1 wherein said first conductor and said second conductor each having a first width at a first end and a second width at a second end, said second width being wider than said first width, each said first end having an electrical connection for energizing said resistive film.

11. An apparatus for heating a substrate, said apparatus comprising:

a substrate having a surface, said substrate being a glass material;

a first conductor adhered to said surface, said first conductor being formed from a first conductive polymer thick film ink;

a second conductor adhered to said surface, said second conductor being formed from a second conductive polymer thick film ink;

a resistive film in contact with said surface, said resistive film being formed from a first polymer thick film carbon ink having a specified conductivity, said resistive film in electrical contact with said first conductor, said resistive film in electrical contact with said second conductor, said resistive film including a plurality of strips, each of said plurality of strips extending from said first conductor to said second conductor, each of said plurality of strips in a spaced apart configuration; and a temperature sensor attached to said substrate, said temperature sensor being a thermistor.

12. The apparatus of claim 11 further comprising a coating in contact with said resistive film, said coating in contact with said first conductor and said second conductor.

13. The apparatus of claim 11 further including a controller in electrical communication with said temperature sensor, said first conductor, and said second conductor, said controller having a circuit formed on said substrate.

14. The apparatus of claim 13 wherein said controller includes at least one resistor in contact with said surface, said at least one resistor formed from a second polymer thick film carbon ink having a specified conductivity;

at least one interconnecting conductor in contact with said surface, said at least one interconnecting conductor formed from said conductive polymer thick film ink; and at least one semiconductor mounted on said substrate.

15. An apparatus for heating a substrate, said apparatus comprising:

a substrate having a surface, said substrate being a glass material;

a means for heating said substrate;

a means for sensing a temperature of said substrate;

a means for controlling said means for heating; and a means for connecting said means for controlling to an electrical power supply.

16. The apparatus of claim 15 wherein said means for controlling being mounted on said substrate.

17. A method of heating a substrate with a resistance heater printed on the substrate, said method comprising the steps of:

(a) applying a conductive polymer thick film ink to a first selected portion of a surface of a glass substrate wherein said first selected portion includes two areas that are electrically insulated from each other;

(b) applying a resistive polymer thick film ink to a second selected portion of said surface, wherein said resistive polymer thick film ink is in contact with each of said two areas;

(c) applying a first voltage to a controller mounted on said glass substrate;

(d) measuring a temperature of said glass substrate with a surface mounted sensor; and (e) controlling said first voltage to produce a second voltage applied to said resistive polymer thick film ink and to maintain a selected temperature.

18. The method of claim 17 further comprising a step of applying a dielectric over selected portions of said conductive ink and said resistive ink.

19. The method of claim 17 further comprising a step of applying a backing sheet over said glass substrate, said conductive polymer thick film ink, and said resistive polymer thick film ink.

20. The method of claim 17 further comprising a step of applying a plurality of electrical connection pads to selected portions of said surface, said plurality of electrical connection pads being formed of solder paste, and a step of mounting at least one component to said substrate, and a step of re-flow soldering said at least one component to said plurality of electrical connection pads.

* * * * *